United States Patent [19]

Kroon et al.

[11] Patent Number: 5,065,893

[45] Date of Patent: Nov. 19, 1991

[54] CATHODIC PROTECTION SYSTEM AND METHOD FOR ABOVE-GROUND STORAGE TANK BOTTOMS

[75] Inventors: David H. Kroon, Spring; Gary Goldsmith, Conroe; Michael K. Baach, Spring, all of Tex.; James B. Bushman, Medina, Ohio

[73] Assignee: Corrpro Companies Inc., Medina, Ohio

[21] Appl. No.: 669,934

[22] Filed: Mar. 15, 1991

[51] Int. Cl.[5] ..... B65D 1/42

[52] U.S. Cl. ..... 220/565; 220/415; 220/660

[58] Field of Search ..... 220/565, 660, 669, 469, 220/415

[56] References Cited

U.S. PATENT DOCUMENTS

| | | | |
|---|---|---|---|
| 3,404,500 | 10/1968 | Akita et al. | 220/565 |
| 3,608,204 | 9/1971 | Ashby | 220/565 |
| 3,917,104 | 11/1975 | Rossitto | 220/565 |
| 4,584,802 | 4/1986 | Casselman et al. | 220/565 |

FOREIGN PATENT DOCUMENTS

| | | | |
|---|---|---|---|
| 491385 | 3/1953 | Canada | 220/565 |

*Primary Examiner*—Joseph Man-Fu Moy
*Attorney, Agent, or Firm*—Renner, Otto, Boisselle & Sklar

[57] ABSTRACT

The invention relates to a cathodic protection system for an above-ground storage tank having a metal bottom, both new and retrofitted bottoms. A leak containing dielectric safety membrane is spaced a short distance below and extends beneath the tank bottom generally parallel thereto forming a narrow envelope. Compacted electrolytic conductor is positioned between the membrane and the tank bottom supporting the tank bottom embedding a horizontally disposed cathodic protection anode, the anode being in the form of a matrix or grid of interconnected titanium bars and ribbons. A reticulate dielectric insulator may be embedded in the electrolytic conductor and positioned directly above the anode and such insulator is operable to keep any portion of the anode from contacting the tank bottom and to maintain a generally uniform spacing between the anode and tank bottom. The ribbons extend transversely of the bars and are spot welded on uniform centers to bars on diameters or major chords of a circular tank bottom. A low profile connection is provided between the bars and power feeds to a rectifier, and for large tank bottoms a multiplicity of such connections strategically spaced are provided. Similarly, a plurality of reference cells both in location and kind may be provided so there are redundant power feeds and reference cells. The anode is constructed by uncoiling, arranging and connecting the bars and ribbons on a compacted layer of electrolytic conductor on the liner. After the conductors are attached and routed to the external rectifier, the insulator may be placed above the anode grid. Further compacted electrolytic conductor fills the openings in the insulator.

45 Claims, 4 Drawing Sheets

CATHODIC PROTECTION SYSTEM AND METHOD FOR ABOVE-GROUND STORAGE TANK BOTTOMS

DISCLOSURE

This invention relates generally as indicated to a cathodic protection system and method of installing the same for above ground storage tank bottoms.

BACKGROUND OF THE INVENTION

Above-ground storage tanks are those which are supported on the ground rather than buried or supported in elevated position. Such tanks can be of substantial size and volume and may range to a football field in diameter or more.

New and rebuilt ground storage tanks use an environmental safety secondary containment liner in the form of a plastic membrane. The liner or membrane is usually spaced a short distance beneath the metal bottom which is supported on compacted earth above and below the liner. The membrane is designed to contain leaks to prevent ground contamination.

Unfortunately, because of the dielectric properties of the secondary containment liner, conventional and widely accepted cathodic protection methods such as those using deep anodes or distributed anodes is no longer applicable. Such systems usually use large anodes which, in any event, would not normally fit in the relatively narrow envelope between the liner and the tank bottom. The dielectric liner effectively blocks the required current flow from such anodes to the tank bottom. Accordingly, to be effective, an anode system has to be placed in the relatively narrow envelope between the liner and the tank bottom.

Many operators have chosen galvanic cathodic protection systems which use zinc or magnesium ribbon anodes. These galvanic anodes ribbon systems are typically installed in parallel lengths between the membrane and the tank bottom floor. This method of cathodic protection can be an effective means of tank bottom corrosion control. However, because of the large volume of anode material required to protect fully the tank bottom, these systems have proven to be quite costly, or are in a reduced configuration which is not capable of providing effective corrosion protection. In addition, the life of galvanic anode systems is limited and usually not commensurate with the design life of the tank.

Also, because most ground storage tanks use complex and highly sensitive leak detectors, it is important that the compacted medium between the liner and tank bottom not be comprised of hydrocarbons or not be carbonaceous. Experiments have shown that conventional electronic conductive carbonaceous backfills, which are widely used with existing impressed current systems, set off such leak detectors or otherwise render them useless. The backfill must not be an electronic conductor to avoid shorting between the anode and bottom, and yet must be capable of being compacted and supporting uniformly high compressive loads. The backfill material, however, must be an electrolytic or ionic conductor.

It is also important that the anode be generally uniformly spaced from the tank bottom and not touch the bottom. If it touches, a short occurs and the system malfunctions, or if it is not substantially uniformly spaced from the tank bottom a near short occurs resulting in non-uniform distribution of the protective current. The area beneath a large ground storage tank is hardly accessible, and convenient repairs are virtually impossible. It is, therefore, important to use as anode materials, components which don't themselves substantially corrode, or which don't form current blocking oxidation layers. Further, the anode and the connections to the anode should provide a thin or low profile and should also be such that the system provides a minimal cathodic protection current substantially uniformly to the entire tank bottom.

SUMMARY OF THE INVENTION

Most new above-ground storage tank have a metal bottom with a leak containing dielectric safety membrane spaced a short distance below, and extending beneath and parallel to the tank bottom forming a relatively narrow envelope. Compacted electrolytic backfill is positioned between the membrane and the tank bottom supporting the tank bottom. A horizontally disposed cathodic protection anode is positioned between the membrane and the tank bottom, the anode being in the form of a matrix or grid of electrically interconnected titanium bars and coated ribbons which may be solid or mesh. In lieu of the preferred titanium, other suitable valve metals may be used such as aluminum, tantalum, zirconium or niobium, and alloys thereof. In one form of the invention a reticulate dielectric insulator may be embedded in the electrolytic backfill and positioned above the anode or between the anode and the tank bottom. Such insulator is operable to keep any portion of the anode from contacting the tank bottom and to maintain a generally uniform spacing between the anode and the tank bottom.

In one form of the invention, the ribbons may form a coated titanium matrix. The ribbons extend transversely of the bars and are spot welded on uniform centers to bars on diameters or major chords of a circular tank bottom. Bars where they cross may also welded to each other. The ribbons also may cross the bars as concentric circles, radii, or spirals. A low profile connection is provided between the bars and rectifier, and for large tank bottoms, a multiplicity of such connections strategically spaced are provided. Similarly, a plurality of reference cells, both in location and kind, may be provided, so there are redundant power feeds and reference cells. The anode is constructed by uncoiling, arranging and connecting the bars and ribbons on a compacted layer of electrolytic backfill on the liner. After the conductors are attached and routed to the external rectifier, the reticulate or mesh insulator may be placed above the anode grid. The reference cells may be positioned before or after placement of the insulator and the remainder of the envelope is filled with an electrolytic conductor such as sand, pea gravel, bentonite clay, or other earthen or synthetic material which is compacted and leveled to form a surface on which the tank bottom is constructed. The compacted electrolytic backfill fills the openings in the insulator to provide a path for current flow. The insulator provides substantially uniform spacing of the anode and, importantly, prevents shorting contact of the anode with the tank bottom during or after construction.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE PREFERRED EMBODIMENTS

Figure 1:
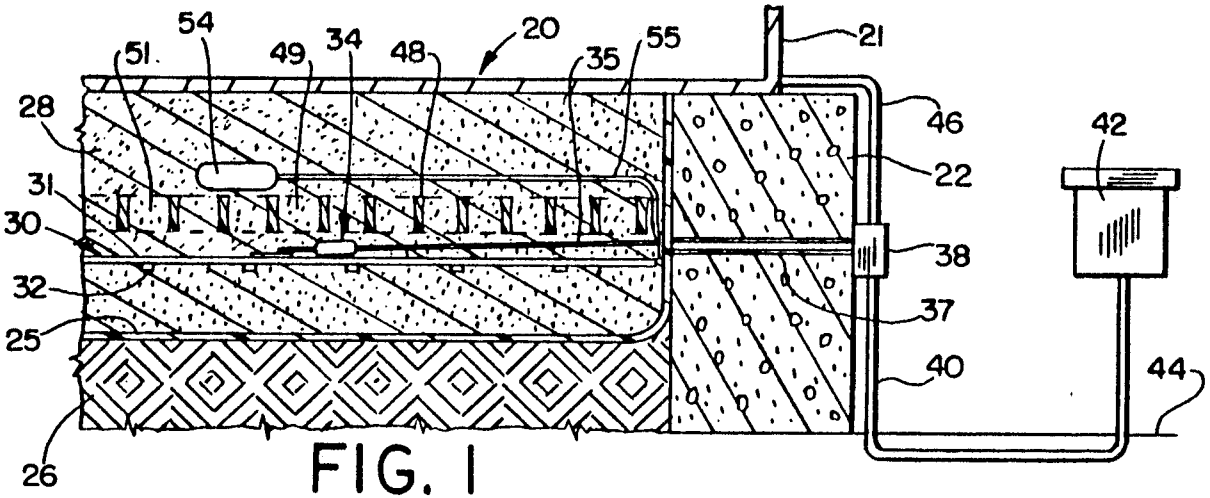
FIG. 1 is a fragmentary vertical section of a cathodic protection system in accordance with the present invention for a new tank bottom.

Referring first to FIG. 1, there is illustrated a cathodic protection system for a new tank bottom which is indicated at 20. The metal tank bottom 20 extends inwardly from tank wall 21 which is positioned over reinforced concrete ring wall or footer 22. Extending along the inside of the ring wall and beneath the bottom wall 20 parallel to the bottom wall is a secondary containment liner 25 which is in the form of a plastic membrane or sheet. The liner is supported on compacted earth 26 within the ring wall. Such tanks are normally circular and very wide in diameter. It is not uncommon for a storage tank to have a diameter approaching that of a football field. However, the vertical distance between the secondary containment liner 25 and the tank bottom 20 is usually a little more than a foot, for example. Thus, the liner forms an envelope with the tank bottom which is significant in horizontal extent or area and yet which is relatively short in height. It is within this envelope that the anode of the cathodic protection system must be constructed and yet be spaced away from the tank bottom.

As seen in FIG. 1, the envelope between the secondary containment liner 25 and the tank bottom 20 is filled with compacted electrolytic backfill indicated at 28. Embedded within the compacted electrolytic backfill is a horizontally extending grid or matrix anode at 30 which is constructed of titanium conductor bars 31 and transversely extending coated titanium ribbons 32, as hereinafter more fully described. The conductor bars 30 are provided with a number of power feed connections shown generally at 34, by which power leads 35 are connected to the anode. The power feed leads extend through conduit 37 through the ring wall to junction box 38. The junction box is electrically connected through conduit 40 to rectifier 42, which is above grade 44. The rectifier, conventionally, is connected to a power source, not shown. A ground lead to the tank extends through conduit 46 from the junction box.

Positioned immediately above the grid anode 30 may be a reticulate or mesh plastic insulator 48, the openings 49 of which in the illustrated embodiment are diamonds or squares approximately 2"×2". The compacted electrolytic backfill fills the openings as indicated at 51. A plurality of reference cells indicated at 54 are provided within the compacted electrolytic backfill, either above or below the anode 30. Such cells are connected through leads 55 through the conduit 37 to terminals in the junction box 38. Compacted electrolytic backfill 28 completely fills the envelope between the secondary containment liner and the tank bottom and affords a working surface on which to construct the tank bottom and which will support the significant compressive loads required.

Figure 3:
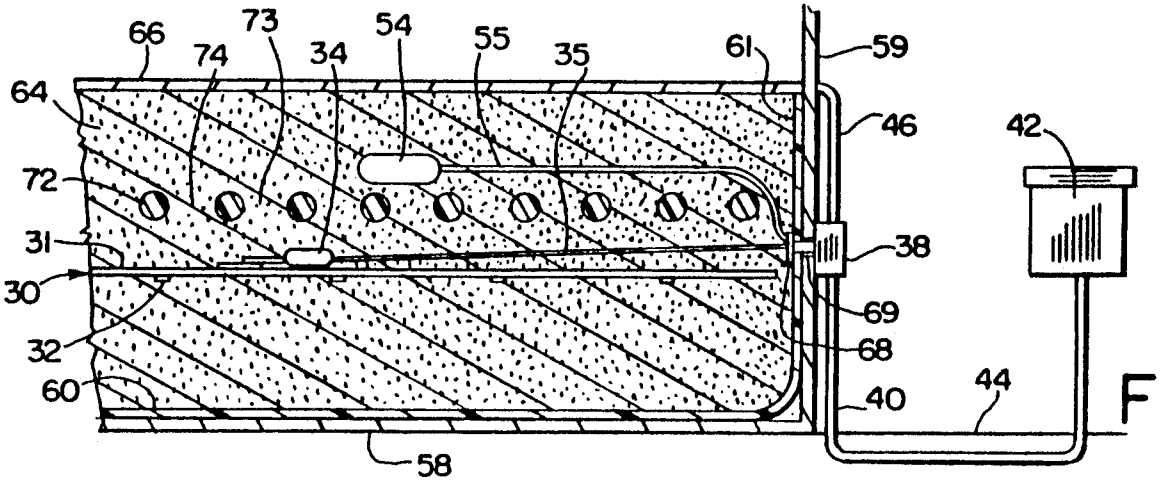
FIG. 3 is a fragmentary vertical section of a cathodic protection system in accordance with the present invention for a double bottom or rebuilt tank.

In FIG. 3 there is illustrated a cathodic protection system for a reconstructed or double-bottom tank. The original tank bottom is indicated at 58 while the tank wall is shown at 59. A secondary containment liner or membrane 60 may extend across the old bottom and along the lower inside of the side wall as indicated at 61. The containment liner is filled with compacted electrolytic backfill indicated at 64 on which the new tank bottom 66 is constructed. The anode 30 may be the same as the anode in FIG. 1 formed of the conductor bars 31 and ribbons 32 in grid fashion and power feed connections 34 being provided between the bars and power leads 35.

The power leads extend through grommet 68 and relatively short conduit 69 to junction box 38 positioned outside of the tank wall 59. The junction box is connected through conduit 40 to rectifier 42. A ground lead is provided through conduit 46 from the junction box to the tank.

Positioned within the compacted electrolytic backfill envelope may be a plastic mesh insulator shown generally at 72 positioned directly above the anode. The plastic mesh insulator 72 may be of slightly different construction than the insulator 48 seen in FIGS. 1 and 2. In any event, the plastic mesh insulator is provided with interstices or openings 73 which may be in the shape of squares or diamonds approximately 2"×2", and at least 1" square. The compacted electrolytic backfill fills such interstices 73 as indicated at 74. Reference cells 54 may be provided as illustrated connected to the junction box by leads 55. As seen in FIG. 3, a new tank bottom may rather conveniently be constructed inside an old tank bottom while nonetheless providing the secondary containment liner 60 and a long lived cathodic protection system for the new tank bottom 66.

Figure 2:
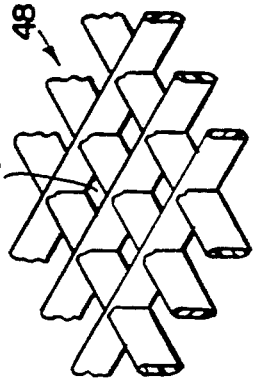
FIG. 2 is a fragmentary perspective view of one form of insulator which may be used with the present invention.
Figure 4:
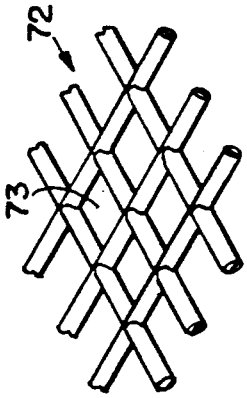
FIG. 4 is a fragmentary perspective view similar to FIG. 2 of another form of reticulate insulator which may be used with the present invention.

With references to FIGS. 2 and 4, it will be appreciated that either type of plastic mesh reticulate insulator may be used with any installation. The mesh of FIG. 4 may, for example, be made of polyethylene plastic forming a 2"×2" diamond and be formed by 5/16" nominal strands which are heat welded to each other at the junctions providing a ⅜" nominal vertical dimension at such junctions.

The mesh of FIG. 2 may be plastic composite with synthetic geo-textiles and may be the type of material utilized to control earthen embankments and soil erosion. In any event, it is important that the openings provided by the mesh not be so large as to permit bars or ribbons of the grid anode to project through and contact the tank bottom. The openings also should not be so small that won't fill with electrolytic backfill to be compacted.

Figure 5:
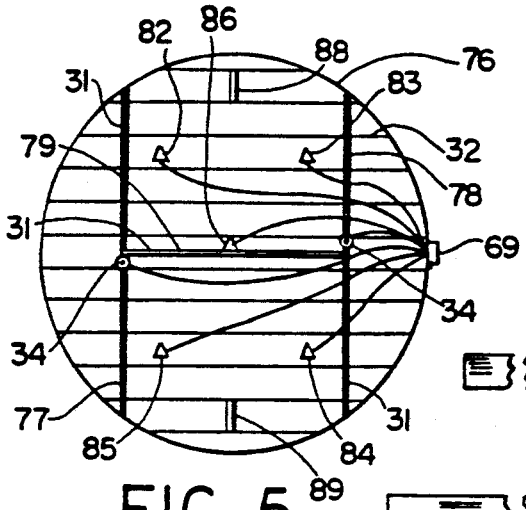
FIG. 5 is a top plan view of the circular anode grid for one size of round tank bottom illustrating the location of the power feed connections and the reference cells.

Referring now to FIG. 5, there is illustrated a typical grid anode layout for a relatively small circular tank bottom 76. The grid includes bars 31 positioned along symmetrical major chords indicated at 77 and 78 which are interconnected by distributor bar 79 on a diameter. The ribbons 32 extend at right angles to the bars 31 on the symmetrical major chords and are spaced on 5 ft. centers. As illustrated, there are two power feed connections 34, one to each of the major bars near the intersection with the distributor bar. The layout of FIG. 5 also includes five zinc, copper sulfate or other reference cells positioned in the symmetrical arrangement as illustrated at 82, 83, 84, 85 and in the center 86. For the outermost ribbon strip, current distributor bars 88 and 89 are provided connecting the ribbon to the nearest ribbon which is, in turn, connected to the conductor bars on the major chords. Each bar/bar ribbon/bar intersection is electrically connected.

Figure 6:
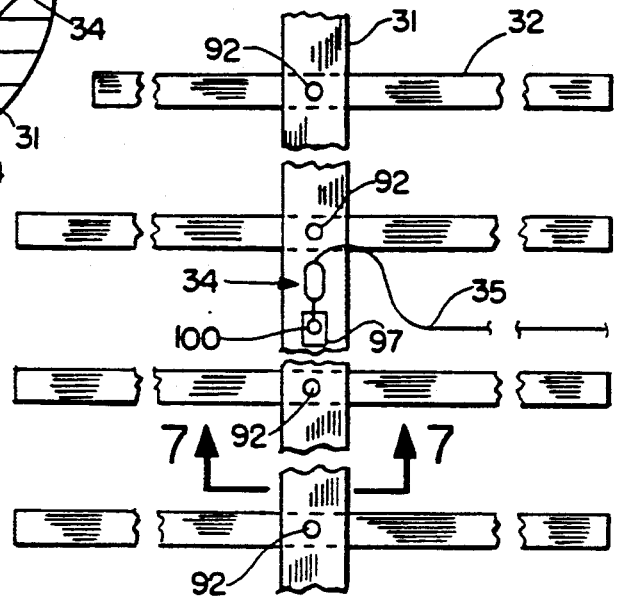
FIG. 6 is an enlarged top plan view of a conductor bar, the transversely extending ribbons connected to the bar, and a power feed connected to the bar.

Referring now to FIG. 6, there is illustrated a conductor bar 31 and the right angle ribbons 32. A resistance or spot weld is provided at each intersections as seen at 92. FIG. 6 also illustrates the power feed 35 and the connection 34 to the conductor bar 31. Such connection is shown in greater detail in FIG. 8. As seen in such figure, the power feed 35 may be a number eight insulated conductor. The exposed copper strands 94 may be secured by hydraulic compression splicing sleeve 95 to titanium conductor rod 96 which is in turn welded to the flat side of a rectangular conductor plate 97. The rod 96 is parallel to the major flat side of the plate 97. A heat shrink sleeve may be provided at 98. The entire joint may be provided with a mastic sealant half lapped over the splice and the entire splice may be encapsulated in epoxy as indicated at 99. The connection to the bar 31 is provided by spot welding the plate 97 to the bar 31 at the specified location as seen at 100. As can be seen from FIGS. 1 and 3, the connection provides an extremely low profile and does not interfere with the placement of the mesh insulator on top of the anode grid.

Figure 7:
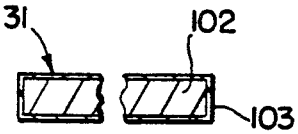
FIG. 7 is an enlarged vertical section through the conductor bar.

Referring now additionally to FIG. 7, there is illustrated a cross section of the bar 31. The ribbon, of course, would be similar but smaller. Both the ribbon and bar have a titanium substrate 102 and may have a coating 103 of either one of the noble metals or of mixed metal oxides. For both the ribbon and the bar, the composition of the substrate is preferably ASTM 265; titanium grade 1. The ribbon is preferably 0.25" in width, 0.025" in thickness, have a weight of 6 lbs. per 500 feet and has a resistance of 0.042 ohms per ft. An anode ribbon with a titanium substrate and with TIR 2000 mixed metal oxide coating, is supplied by Materials Protection Company of Houston, Texas. The ribbons come in 500 ft. reels.

The conductor bar may be of the same substrate. The conductor bars are used to form the grid pattern and thereby reduce the voltage drop along the ribbons. The conductors are preferably 0.5" in width, 0.040" in thickness, has a weight of 10 lbs. per 250 ft., and have a resistance of 0.013 ohms per ft. Such conductor bars are available in 250 ft. coils.

Reference may be had to prior U.S. Pat. Nos. 4,519,886 or 4,331,528, or U.K. publication 896912, published May 23, 1962, all of which show titanium anodes with either mixed metal oxide coatings or noble metal coatings which may be used with the present invention.

For the permanent reference cells, it is preferred to use two types of reference cells. One type is a zinc reference cell which may be a 1.4"×1.4"×9" electrode, pre-packaged in quick wetting backfill. The zinc alloy of the electrode should conform to ASTM B-418-80 Type II.

The other type of reference cell preferred is a copper/copper sulfate reference cell which is constructed of a 2" diameter by 8" long schedule 80 PVC pipe with an ion trap on one end to prevent contamination. The electrode has a long design life and a stability of +or−5 millivolts under a 3.0 microamp. It It is shipped with a cloth sack with special backfill. The leads 55 to the permanent reference electrode are insulated with a high molecular weight polyethylene insulation and the leads should be of sufficient length to extend to the junction box 38 without splicing.

Figure 9:
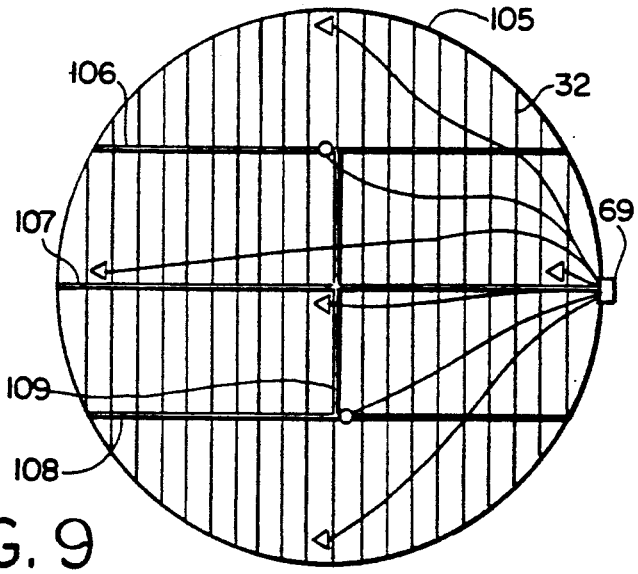
FIG. 9 is a view similar to FIG. 5 of a larger tank bottom.

Referring now additionally to FIG. 9, there is illustrated a grid layout for a somewhat larger tank 105 than that shown in FIG. 5. The anode ribbons 32 extend at right angles to conductor bars 31 which are positioned on a major chord indicated at 106, a diameter indicated at 107, and a symmetrical major chord 108. The three major conductor bars are interconnected by a conductor bar 109. Two power feed connections are provided near the centers of the major chord conductor bars 106 and 108, while five permanent reference electrodes are provided as indicated by the triangular symbols. For illustration purposes, the tank bottom of FIG. 5 may be approximately 60 ft. in diameter while the tank bottom of FIG. 9 is approximately 121 ft. in diameter.

Figure 10:
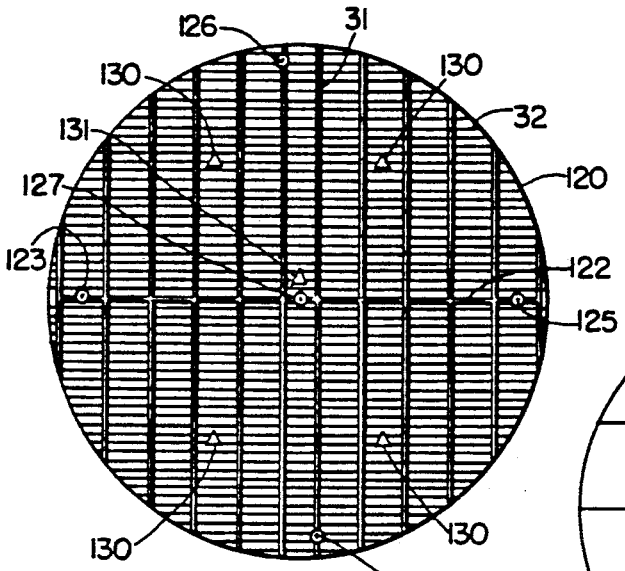
FIG. 10 is a similar top plan view of a much larger tank bottom with the location of the power feed connections and reference cells illustrated.

In FIG. 10, there is illustrated a tank bottom which is approximately 283 ft. in diameter. In FIG. 9 the ribbons may be on a 6 ft. centers along the conductor bars while in FIGS. 5 and 10 the spacing may be 5 ft. center to center. In any event, the large tank 120 of FIG. 10 is provided with a grid anode formed by the ribbons 32 extending normal to the conductor bars 31 which are on chords of the circle of the bottom. Typically, the major conductor bars may be spaced 25 ft. apart and each of the conductor bars is connected diametrically by conductor bar 22. The circular dots seen at 123, 124, 125, 126 and 127 illustrate points of connection of the power feeds. The triangular symbols 130 illustrate the positions of the permanent reference cells. As illustrated, such positions are arranged generally symmetrically about a center reference cell 131.

Figure 11:
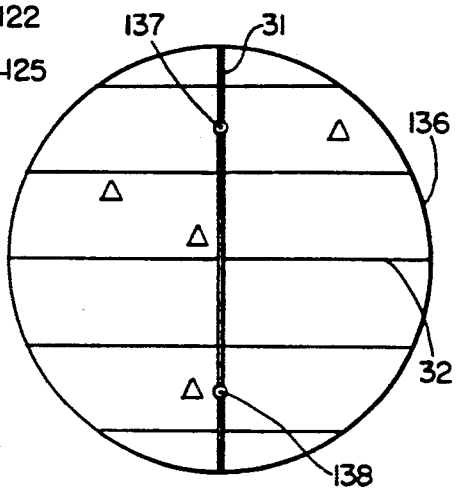
FIG. 11 is a similar view of a smaller grid anode for smaller tank bottoms and with the location of the power feed connections and reference cells illustrated.

FIG. 11 illustrates an anode grid for a storage tank which may be only approximately 25 ft. in diameter. The tank 136 is provided with a single diametral conductor bar 31 and transversely extending ribbons 32 on typical 5 ft. centers. Again, two power feed connections may be provided as indicated at 137 and 138 and the position of the permanent reference cells is shown by the triangular symbols. In any event, the bars are typically arranged to form diameters or major chords of the circular tank bottom with the ribbons extending normal or perpendicular to the conductor bars on the required centers. A plurality of power feed connections as well as permanent reference cells is provided to create desired redundancy.

Figure 12:
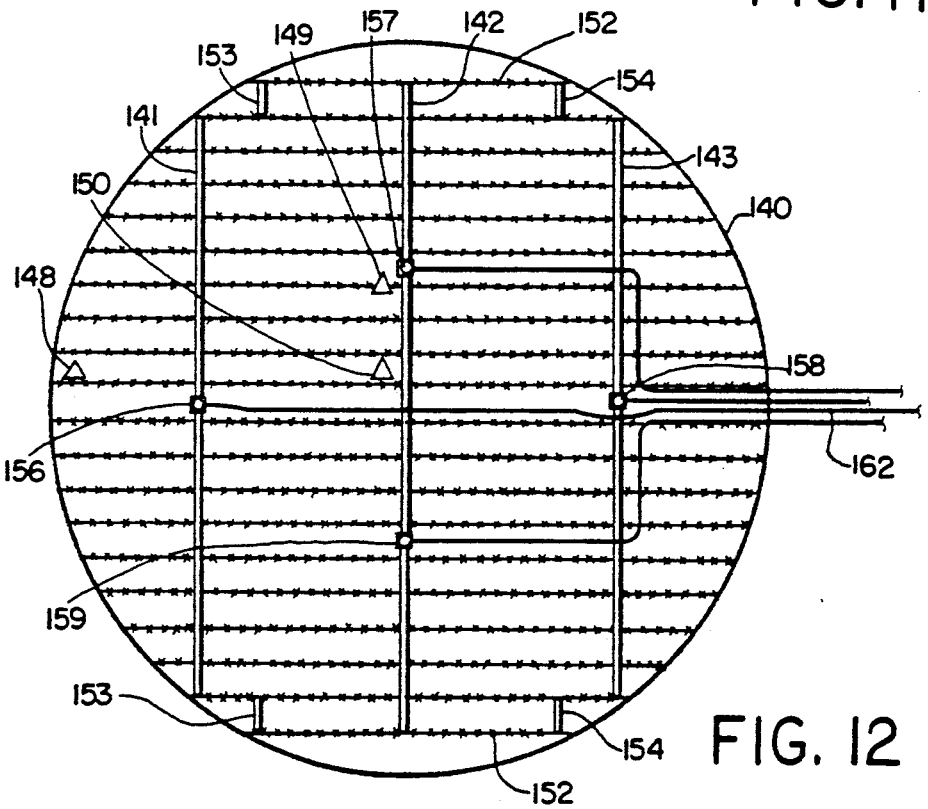
FIG. 12 is a top plan view of a grid anode in accordance with the present invention utilizing mesh as the ribbon.
Figure 13:
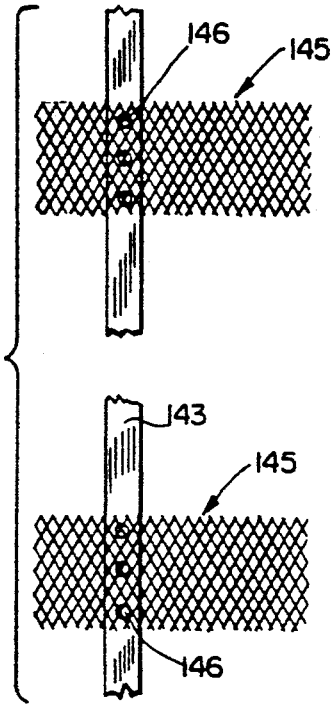
FIG. 13 is an enlarged view of the mesh-bar connection.

Referring now to FIG. 12, there is illustrated a somewhat modified form of the present invention. A circular tank 140 utilizes an anode grid formed of chordal conductor bar 141, diametral conductor bar 142 and symmetrically disposed chordal conductor bar 143. Extending normal to such conductor bars on approximately 4 ft. centers are anode mesh strips indicated at 145. The mesh strips are fabricated from 0.025" thick high purity titanium sheet expanded to provided total anode surface area of approximately 1.90 sq. ft. per each sq. ft. of expanded strip. The expanded strip is then coated or catalyzed with a precious metal oxide coating. The mesh strips or ribbons are approximately 1.25" wide. As seen more clearly in FIG. 13, the mesh ribbons are secured to the conductor or distributor bars 143 by three spot welds indicated at 146. The conductor bars to which the mesh ribbons are welded may be of the same material as in the prior embodiment, but a preferred dimension is 0.05" thick by 0.075" wide. Reverting to FIG. 12, three permanent copper sulfate reference electrodes may be provided as indicated at 148, 149 and 150. Also, relatively short current distributor bars may be provided for the shortest mesh ribbons 152 as seen at 153 and 154. Also, there is provided four power lead connections seen at 156, 157, 158 and 159.

Figure 8:
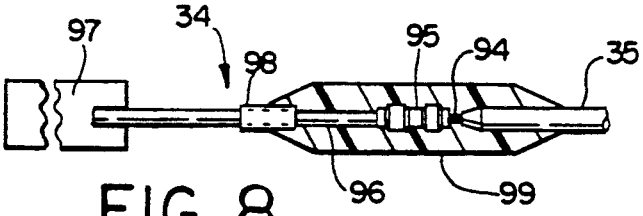
FIG. 8 is an enlarged horizontal section through the power feed connection to the bar.
Figure 14:
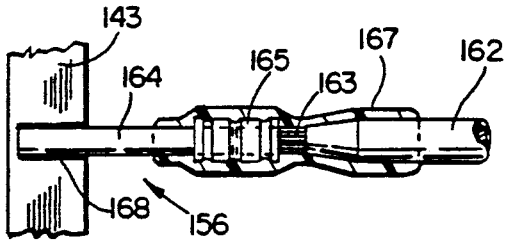
FIG. 14 is a horizontal section of a power feed-bar connection for the embodiment of FIGS. 12 and 13.

Such connections are slightly different than the connections seen in FIG. 8. As illustrated in FIG. 14, the insulated power feed 162 had the strands 163 of the cable connected to titanium rod 164 by a hydraulically compressed butt crimp connector 165. The entire connection is encapsulated in heat shrink tubing with an adhesive sealant as seen at 167. The rod 164 is then welded as indicated at 168 to the flat top side of the conductor bar 143. This connection thus forms the low profile connections 156 through 159.

Figure 15:
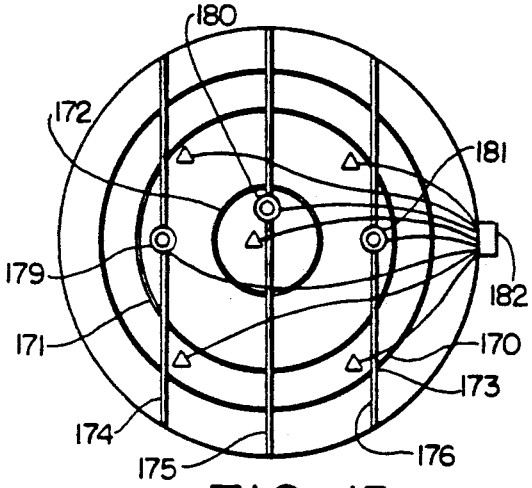
FIG. 15 is a top plan view of an anode wherein the ribbon is arranged as concentric rings secured to the chordal or diametric conductor bars.
Figure 16:
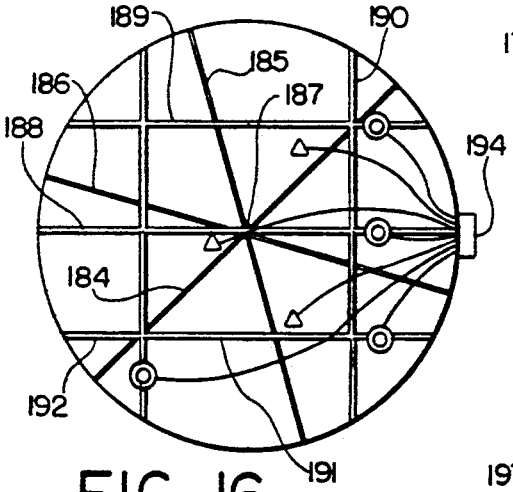
FIG. 16 is a similar view with the ribbons arranged as radii and secured to the conductor bars; and, FIG. 17 is a similar view with the ribbon arranged as a spiral and secured to the conductor bars.
Figure 17:
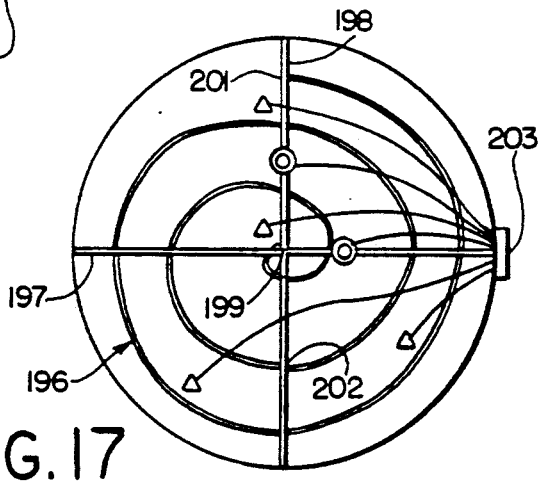

Referring now to FIGS. 15-17, there is illustrated some embodiments of the present invention where the ribbon is arranged in a variety of patterns on the conductor bar.

In FIG. 15, the ribbon is arranged in three concentric rings 170, 171 and 172, welded, where they cross such as indicated at 173, to the three conductor bars 174, 175 and 176. The ribbon as described above is sufficiently flexible that it can be laid out on a curvature to form the ring with the leading end simply welded to the trailing end to form a continuous conducting ring. It is noted that the spacing between the rings decreases as the circumference increases to achieve substantially uniform distribution. This change of spacing is applicable to larger tank bottoms. Also, as illustrated, there are three power feed connections 179, 180 and 181 through the junction box 182 as well as the five somewhat symmetrically arranged reference electrodes shown by the triangular symbols.

In FIG. 16, there are illustrated three ribbons equally circumferentially spaced, shown at 184, 185 and 186 which intersect each other at the center of the tank bottom as indicated at 187, forming six radii. The ribbons may be welded together at the center and to the diametral conductor bar 188. As illustrated, there are four chordal conductor bars 189, 190, 191 and 192, each welded to each intersecting bar and ribbon at such intersection. The arrangement of FIG. 16 includes four power feed connections and three reference electrodes, all through the junction box 194.

In FIG. 17, there is shown a single anode ribbon 196 which is in the form of a spiral. The anode of FIG. 17 includes two right angle diametrical electrically connected conductor bars 197 and 198 intersecting at the tank bottom center 199, which is also the location of one end of the spiral ribbon 196. The opposite end is shown at 201. The ribbon is electrically secured to each bar at the points of intersection, such as shown at 202. As with the concentric ring embodiment, the change of radius, as the radius increases, may diminish, from one point on the spiral to the next. As shown, there are two power feed connections and four reference electrodes in the embodiment of FIG. 17, all wired through junction box 203.

INSTALLATION

The cathodic protection system is installed after the tank erection contractor has constructed the ring wall in the case of a new tank in FIG. 1, and in any event, placed the secondary containment liner in position, either within the ring wall or within the old tank bottom, and compacted 1 to 4 inches of electrolytic backfill above the liner. The top of the 1 to 4 inch layer of compacted electrolytic backfill provides a working surface on which to construct the anode grid.

Initially, the anode ribbon is unrolled from the spools at the spacing shown or specified. The ribbon may be pulled through straightener roll sets or may be held in any event in place with electrolytic backfill bags as required to keep the ribbon from rising above the compacted electrolytic backfill. When the ribbons are in place in the proper uniform parallelism, the conductor bar may be uncoiled and positioned in the proper locations at right angles to the ribbon. Each ribbon and conductor bar intersection is then resistance welded. Also, any intersection of conductor bar is also spot welded and each weld should be checked carefully to insure that it is proper and secure providing a good electrical connection between the intersecting parts.

The power feed connectors may be prefabricated and they are connected to the conductor bar at the locations specified. Each power feed conductor is routed through the conduit in the ring wall or the grommet in the rebuilt tank as the case may be.

After the anode grid is constructed on the intermediate layer of compacted electrolytic backfill, the mesh or reticulate plastic insulator may be installed directly above the entire anode grid. Again, electrolytic backfill bags or weights may be employed to keep the plastic mesh and anode grid from rising above the compacted electrolytic backfill.

The permanent reference cells may be installed at the desired locations. The cloth sack containing the reference cell should be soaked in the container of water for 15-20 minutes and the reference cell may be placed in a hole in the electrolytic backfill surface and the cell is simply backfilled with additional electrolytic backfill to prevent drying. Again, the leads to the reference cells are routed through the ring wall or tank wall to the junction box. The backfilling of additional electrolytic backfill above the mesh insulator may be accomplished in stages to locate the reference cells where desired, or the reference cells may be positioned beneath the anode grid before the mesh insulator is put in place on the anode grid.

In any event, the backfilling operation within the ring wall or the old tank is performed by the tank erection contractor and a small track dozer may be employed for placing the electrolytic backfill in the required lifts above the anode ribbon, conductor bars and reference cells. The dozer should have preferably no cleats or if it does have cleats, the cleats should not be greater than 2.5". Great care should be exercised during the backfill operation to avoid damage to the anode grid and wiring. In any event, electrolytic backfill is placed over the reticulate insulator and is compacted and leveled. The compacting not only assures proper compressive loads, but also insures that the electrolytic backfill will fill the openings or interstices in the plastic mesh insulator when employed. Electrical testing should be conducted during the final stages of tank pad construction and if problems occur, remedial action should be taken.

Resistance measurements between the power feed should be monitored during the placement of the electrolytic backfill above the cathodic protection anode grid and reference cells. These measurements should be supplemented by additional resistance and/or potential readings between the reference cells and power feeds. Abrupt increases in resistance indicate damage to the system components during pad construction. At that point repair should be undertaken immediately. In any event, when the pad of compacted electrolytic backfill is completed and leveled, the construction of the tank bottom may commence.

The system may be commissioned by taking native state tank-to-soil measurements to be recorded. The rectifier unit then will be energized and sufficient time for polarization of the tank bottom will be allowed. Final adjustments to the system will be made when the tank is at least partially filled with product. The criterion for adjustment may be a 100 millivolt polarization shift, or other recognized standard.

It should be noted that the system avoids utilization of highly conductive carbonaceous backfill materials which are employed normally to cause most conventional cathodic protection anodes to function properly. The cathodic protection system of the present invention with its redundant power feeds and reference cells provides a long service life at reasonable cost.

We claim:

1. In combination, an above-ground storage tank having a metal bottom, a leak containing dielectric safety membrane spaced a short distance below and extending beneath the tank bottom generally parallel thereto, compacted electrolytic backfill positioned between the membrane and the tank bottom supporting the tank bottom, a horizontally disposed cathodic protection anode between the membrane and tank bottom, said anode being in the form of a grid of interconnected bars and ribbons, and a mesh dielectric insulator embedded in the electrolytic backfill and positioned between the anode and tank bottom operable to keep any portion of the anode from contacting the tank bottom and to maintain a generally uniform spacing between the anode and tank bottom.

2. The combination set forth in claim 1 wherein said ribbons extend transversely of said bars on uniform centers and are electrically connected to the bars.

3. The combination set forth in claim 2 wherein said bars are arranged to form diameters or major chords of a circular tank bottom.

4. The combination set forth in claim 2 wherein said bars and ribbons are welded to each other.

5. The combination set forth in claim 4 wherein the ribbons are in the form of concentric circles.

6. The combination as set forth in claim 4 wherein the ribbons are formed as a spiral, the center of which is substantially the center of the circular tank bottom.

7. The combination as set forth in claim 4 wherein the ribbons extend diametrically or radially of the circular tank bottom.

8. The combination set forth in claim 1 wherein said bars and ribbons are a metal selected from the group of aluminum, titanium, tantalum, zirconium, or niobium, and alloys thereof and said ribbons are coated.

9. The combination set forth in claim 8 including at least one low profile power feed connection to the bar.

10. The combination set forth in claim 9 wherein said power feed connection includes a power feed terminating rod, and a flat plate parallel to and adjacent the end of the rod adapted to be secured to the bar.

11. The combination set forth in claim 9 including a plurality of power feed connections electrically connecting the bars at different locations to a rectifier.

12. The combination set forth in claim 1 wherein said ribbon is in the form of an open mesh.

13. In combination, an above-ground storage tank having a metal bottom, a safety membrane spaced a short distance below and extending parallel to and beneath the bottom to provide a narrow envelope, compacted electrolytic backfill within said envelope supporting said tank bottom, a horizontally disposed cathodic protection anode positioned between the tank bottom and membrane within said electrolytic backfill, said anode comprising at least one valve metal electrically connected conductor bar, and coated valve metal anode ribbons of smaller cross section extending transversely of and connected to said bar, said bar and ribbons forming a uniform grid extending beneath said tank bottom, and a plurality of power feed connections to said bar positioned to provide a minimal cathodic protection current uniformly from the anode to the entire tank bottom.

14. The combination set forth in claim 13 including means positioned between the anode and tank bottom to preclude shorting contact between the anode and bottom.

15. The combination set forth in claim 14 wherein said last mentioned means comprises a layer of dielectric mesh insulator having openings accommodating compacted electrolytic backfill to permit current flow through such openings.

16. The combination set forth in claim 15 wherein said insulator is formed of overlapping and heat welded polyethylene strands.

17. The combination set forth in claim 16 wherein each opening is at least one inch square.

18. The combination set forth in claim 13 wherein said valve metal is selected from the group of aluminum, titanium, tantalum, zirconium or niobium, or alloys thereof.

19. The combination set forth in claim 13 wherein said ribbons extend transversely of said bar on substantially uniform centers and are electrically connected to the bar.

20. The combination set forth in claim 13 including more than one bar and wherein said bars are arranged to form diameters or major chords of a circular tank bottom.

21. The combination set forth in claim 20 wherein said bars and ribbons are welded to each other.

22. The combination set forth in claim 21 wherein the ribbons are in the form of concentric circles.

23. The combination as set forth in claim 21 wherein the ribbons are formed as a spiral, the center of which is substantially the center of the circular tank bottoms.

24. The combinations as set forth in claim 21 wherein the ribbons extend diametrically or radially of the circular tank bottom.

25. The combination set forth in claim 21 including at least one low profile conductor connection to the bar.

26. The combination set forth in claim 25 wherein said power feed connection includes a flat plate parallel to and adjacent the end of the power feed adapted to be secured to the bar.

27. The combination set forth in claim 25 including a plurality of power feeds electrically connecting the bars at different locations to a rectifier.

28. The combination set forth in claim 13 wherein said ribbon is in the form of an open mesh.

29. A method of constructing or reconstructing an above-ground storage tank comprising the steps of providing a horizontally extending safety membrane, supporting the membrane on the ground or if a reconstruction on the old tank bottom, placing a layer of compacted electrolytic backfill on the membrane to provide a horizontal working surface, constructing a cathodic protection grid anode on the layer of compacted electrolytic backfill by interconnecting valve metal conductor bar and coated ribbons to provide a uniform density grid, connecting a power feed to the bars at a plurality of locations, covering said anode with electrolytic backfill, compacting and leveling such electrolytic backfill, constructing a new metal tank bottom on the compacted electrolytic backfill, and connecting the power feed to a rectifier to supply DC current to said grid anode in turn to provide a minimal cathodic protection current uniformly from the anode grid to the entire new tank bottom.

30. A method as set forth in claim 29 including the step of unrolling the ribbon from said spools to form ribbon lengths parallel to each other on uniform centers.

31. A method as set forth in claim 30 including the step of unrolling the conductor bar from spools on a diameter or major chords of a circular tank bottom with the conductor bars extending transversely to the parallel ribbons.

32. A method as set forth in claim 31 including the step of electrically connecting the ribbon and bar at each intersection to form the grid.

33. A method as set forth in claim 32 including the step of forming the ribbon as concentric circles.

34. A method as set forth in claim 32 including the step of forming the ribbon as a spiral.

35. A method as set forth in claim 32 including the step of forming the ribbon as radiating from the center of the circular tank bottom.

36. A method as set forth in claim 32 including the step of resistance welding each bar and ribbon intersection to form a secure electrical connection.

37. A method as set forth in claim 36 including the step of electrically connecting power feeds to the bar at one or more locations with a low profile connection.

38. A method as set forth in claim 37 including the step of placing an open mesh dielectric insulator over the top of the anode grid.

39. A method as set forth in claim 38 including the step of unrolling the insulator from spools over the top of the anode grid.

40. A method as set forth in claim 37 including the step of installing reference cells at a one or more specified locations within the anode grid.

41. A method as set forth in claim 40 including the step of backfilling and compacting electrolytic backfill over the grid and insulator insuring that the electrolytic backfill fills the openings of the insulator and that no portion of the anode grid projects above the insulator.

42. A method as set forth in claim 29 wherein said ribbons are in the form of open mesh.

43. A method as set forth in claim 29 including the step of compacting and leveling the electrolytic backfill over the anode grid and constructing a new tank bottom on the compacted and leveled electrolytic backfill.

44. A method as set forth in claim 39 including supplying direct current to said anode grid to impress a current from the anode grid to the tank bottom for cathodic protection.

45. A method as set forth in claim 29 wherein the valve metal is selected from the group of aluminum, titanium, tantalum, zirconium, or niobium, or alloys thereof.

* * * * *